US009922602B2

(12) United States Patent
Katsu et al.

(10) Patent No.: US 9,922,602 B2
(45) **Date of Patent: *Mar. 20, 2018**

(54) DISPLAY DEVICE AND DISPLAY METHOD

(71) Applicant: Sony Corporation, Tokyo (JP)

(72) Inventors: Yoshihiro Katsu, Kanagawa (JP); Tomohiro Nishi, Tokyo (JP); Akihiro Ohta, Tokyo (JP); Mitsuyasu Asano, Tokyo (JP)

(73) Assignee: Sony Corporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/409,994

(22) Filed: Jan. 19, 2017

(65) Prior Publication Data

US 2017/0132981 A1 May 11, 2017

Related U.S. Application Data

(63) Continuation of application No. 14/844,144, filed on Sep. 3, 2015, now Pat. No. 9,583,052, which is a (Continued)

(30) Foreign Application Priority Data

Nov. 10, 2011 (JP) ..... 2011-246770

(51) Int. Cl.
*G09G 3/34* (2006.01)
*G09G 3/36* (2006.01)

(52) U.S. Cl.
CPC ..... *G09G 3/3426* (2013.01); *G09G 3/36* (2013.01); *G09G 2320/0285* (2013.01); *G09G 2320/062* (2013.01); *G09G 2320/0646* (2013.01)

(58) Field of Classification Search
None
See application file for complete search history.

(56) References Cited

U.S. PATENT DOCUMENTS 8,139,020 B2 3/2012 Ohshima
8,139,022 B2 3/2012 Ohshima
(Continued)

FOREIGN PATENT DOCUMENTS

CN 101572066 A 11/2009
EP 1564478 A1 8/2005
(Continued)

OTHER PUBLICATIONS

European Search Report from EP Application No. 12191148, dated Feb. 7, 2013.
(Continued)

*Primary Examiner* — Seokyun Moon
(74) *Attorney, Agent, or Firm* — Lerner, David, Littenberg, Krumholz & Mentlik, LLP

(57) ABSTRACT

Disclosed herein is a display device including: a liquid crystal display section adapted to display an image based on a video signal; a backlight; and a processing section adapted to correct the video signal and set the luminance of the backlight based on two pieces of information, a peak level of the video signal in a display screen or in each of a plurality of partial display areas into which the display screen is divided, and factor data obtained from a data map made up of a reference position on the display screen and the factor data that are associated with each other.

9 Claims, 12 Drawing Sheets

Related U.S. Application Data continuation of application No. 13/667,529, filed on Nov. 2, 2012, now Pat. No. 9,159,273.

(56) References Cited

U.S. PATENT DOCUMENTS

| | | | | |
|---|---|---|---|---|
| 9,159,273 | B2 * | 10/2015 | Katsu | G09G 3/3426 |
| 2005/0128374 | A1 | 6/2005 | Furukawa | |
| 2006/0238487 | A1 | 10/2006 | Shih | |
| 2008/0297463 | A1 | 12/2008 | Tsuru et al. | |
| 2009/0109165 | A1 | 4/2009 | Park et al. | |
| 2010/0039440 | A1 | 2/2010 | Tanaka et al. | |
| 2011/0292018 | A1 | 12/2011 | Kubota et al. | |

FOREIGN PATENT DOCUMENTS

| | | | |
|---|---|---|---|
| EP | 2113904 | A2 | 11/2009 |
| EP | 2154673 | A2 | 2/2010 |
| JP | 2009-042652 | A | 2/2009 |
| JP | 2010-113099 | A | 5/2010 |

OTHER PUBLICATIONS

China Office Action for Patent No. 201210433438.X dated Jan. 28, 2016.

European Examination for Application No. 12191148.1 dated Aug. 2, 2016.

* cited by examiner

DISPLAY DEVICE AND DISPLAY METHOD

CROSS-REFERENCE TO RELATED APPLICATIONS

The present application is a continuation of patent application Ser. No. 14/844,144 filed Sep. 3, 2015, which is a continuation of application Ser. No. 13/667,529 filed Nov. 2, 2012, issued as U.S. Pat. No. 9,159,273, which claims the benefit of Japanese Patent Application No. 2011-246770 filed Nov. 10, 2011, the disclosures of which are incorporated herein by reference.

BACKGROUND

The present disclosure relates to a display device having liquid crystal display elements and to a display method thereof.

Recent years have seen an increasing transition from CRTs (Cathode Ray Tubes) to slim display devices such as liquid crystal display devices. In particular, liquid crystal display devices are on their way to going mainstream for low power consumption.

As for liquid crystal display devices, several technologies have been proposed to further reduce the power consumption. For example, Japanese Patent Laid-Open No. 2009-42652 and Japanese Patent Laid-Open No. 2010-113099 disclose display devices that are designed to independently control the emission luminance of the backlight (partially drive the backlight) in each of a plurality of areas into which the backlight is divided according to luminance information of a video signal.

SUMMARY

Ecology has been attracting attention today, and liquid crystal display devices are expected to further reduce their power consumption.

In light of the foregoing, it is desirable to provide a display device and display method that can contribute to reduced power consumption.

A display device according to a first embodiment of the present disclosure includes a liquid crystal display section, backlight and processing section. The liquid crystal display section displays an image based on a video signal. The processing section corrects the video signal and sets the luminance of the backlight based on two pieces of information, a peak level of the video signal in a display screen or in each of a plurality of partial display areas into which the display screen is divided, and factor data obtained from a data map made up of a reference position on the display screen and the factor data that are associated with each other.

A display device according to a second embodiment of the present disclosure includes a liquid crystal display section, backlight and processing section. The liquid crystal display section displays an image based on a video signal. The processing section corrects the video signal and sets the luminance of the backlight based on two pieces of information, a peak level of the video signal in a display screen or in each of a plurality of partial display areas into which the display screen is divided, and a peak position, i.e., a position on the display screen where the peak level occurs.

A display device according to a third embodiment of the present disclosure includes a liquid crystal display section, backlight and processing section. The liquid crystal display section displays an image based on a video signal. The backlight has a plurality of partial light-emitting sections.

The processing section corrects the video signal and sets the luminance of each of the partial light-emitting sections based on two pieces of information, a peak level of the video signal in a partial display area associated with one of the partial light-emitting sections, and the position of that partial display area.

A display method according to an embodiment of the present disclosure corrects a video signal and sets the luminance of a backlight based on two pieces of information, a peak level of the video signal in a display screen or in each of a plurality of partial display areas into which the display screen is divided, and factor data obtained from a data map made up of a position on the display screen and the factor data that are associated with each other so as to display an image based on the corrected video signal.

In the display device according to the first embodiment and display method according to the embodiment of the present disclosure, the liquid crystal display section displays an image based on the video signal. At this time, the video signal is corrected, and the luminance of the backlight is set, based on the peak level and the factor data obtained from the data map. An image is displayed based on the corrected video signal.

In the display device according to the second embodiment of the present disclosure, the liquid crystal display section displays an image based on the video signal. At this time, the video signal is corrected, and the luminance of the backlight is set, based on the peak level and peak position. An image is displayed based on the corrected video signal.

In the display device according to the third embodiment of the present disclosure, the liquid crystal display section displays an image based on the video signal. At this time, the video signal is corrected, and the luminance of the partial light-emitting section associated with the partial display area is set, based on the peak level and the position of the partial display area. An image is displayed based on the corrected video signal.

The display device according to the first embodiment and display method according to the embodiment of the present disclosure correct the video signal and set the luminance of the backlight based on the peak level and the factor data obtained from the data map, thus providing reduced power consumption.

The display device according to the second embodiment of the present disclosure corrects the video signal and sets the luminance of the backlight based on the peak level and peak position, thus providing reduced power consumption.

The display device according to the third embodiment of the present disclosure corrects the video signal and sets the luminance of the partial light-emitting section based on the peak level and the position of the partial display area, thus providing reduced power consumption.

DETAILED DESCRIPTION OF THE PREFERRED EMBODIMENTS

A detailed description will be given below of the preferred embodiments of the present disclosure with reference to the accompanying drawings. It should be noted that the description will be given in the following order.

1. First Embodiment
2. Second Embodiment
3. Third Embodiment

1. First Embodiment

Configuration Example

Example of the Overall Configuration

Figure 1:
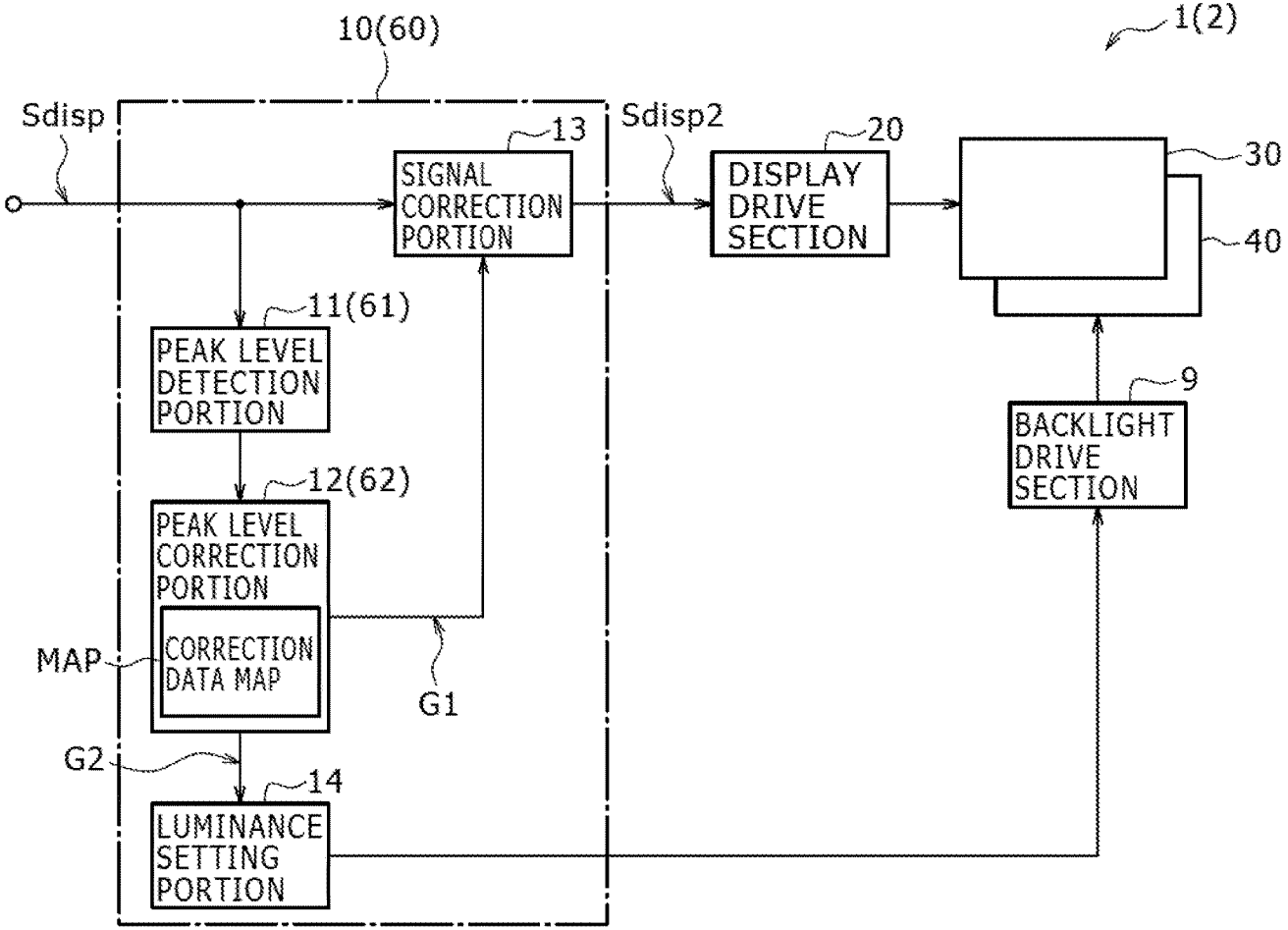
FIG. 1 is a block diagram illustrating a configuration example of a display device according to a first embodiment of the present disclosure.

FIG. 1 illustrates a configuration example of a display device according to a first embodiment. A display device 1 is a transmissive liquid crystal display device having a backlight. It should be noted that the display method according to the embodiments of the present disclosure is implemented by the present embodiment. Therefore, the display method will be described together with the first embodiment.

The display device 1 includes a signal processing section 10, display drive section 20, liquid crystal display section 30, backlight drive section 9 and backlight 40.

The signal processing section 10 generates a video signal Sdisp2 and sets the luminance of the backlight 40 based on a video signal Sdisp. The signal processing section 10 will be described in detail later.

The display drive section 20 drives the liquid crystal display section 30 based on the video signal Sdisp2 supplied from the signal processing section 10. The liquid crystal display section 30 includes liquid crystal display elements and displays an image by modulating light emitted from the backlight 40.

Figure 2:
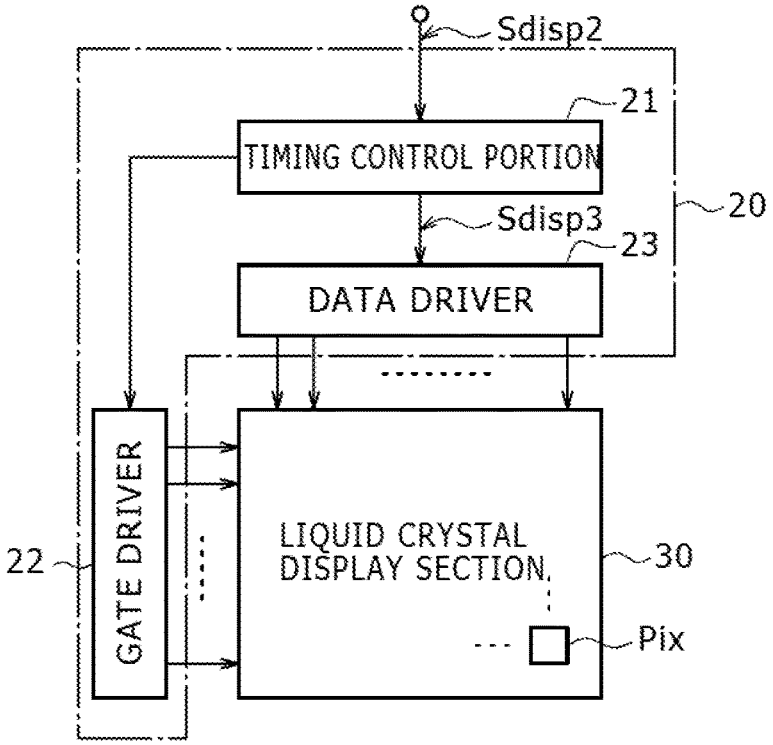
FIG. 2 is a block diagram illustrating a configuration example of a display drive section and liquid crystal display section shown in FIG. 1.

FIG. 2 illustrates an example of a block diagram of the display drive section 20 and liquid crystal display section 30. The display drive section 20 includes a timing control portion 21, gate driver 22 and data driver 23. The timing control portion 21 controls the drive timings of the gate driver 22 and data driver 23, and supplies the video signal Sdisp2, supplied from a control section 24, to the data driver 23 as a video signal Sdisp3. The gate driver 22 selects pixels Pix in the liquid crystal display section 30 one row at a time in sequence under timing control of the timing control portion 21, thus progressively scanning the pixels Pix. The data driver 23 supplies a pixel signal based on the video signal Sdisp3 to each of the pixels Pix of the liquid crystal display section 30. More specifically, the data driver 23 handles digital-to-analog conversion based on the video signal Sdisp3, thus generating a pixel signal, i.e., an analog signal, and supplying the pixel signal to each of the pixels Pix.

The liquid crystal display section 30 has a liquid crystal material sealed between two transparent substrates that are made, for example, of glass. Transparent electrodes, made, for example, of ITO (Indium Tin Oxide) are formed in the areas of these transparent substrates facing the liquid crystal material, thus making up the pixels Pix together with the liquid crystal material.

Figure 3:
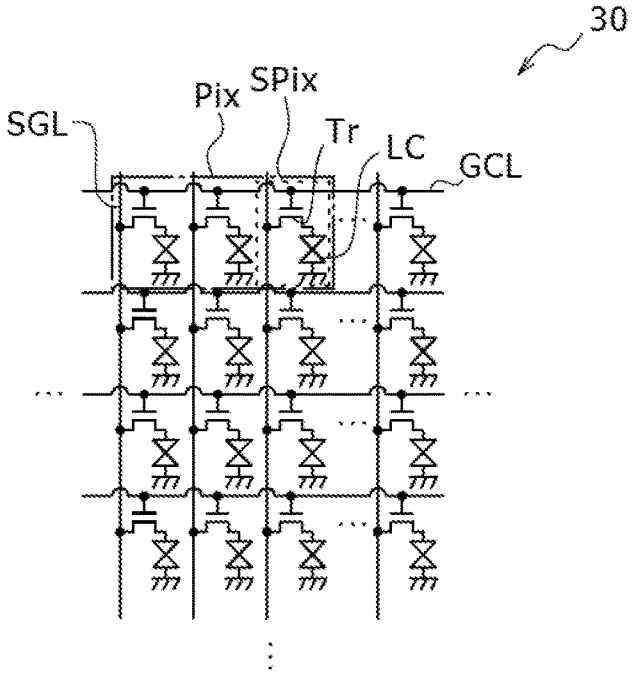
FIG. 3 is a circuit diagram illustrating a configuration example of the liquid crystal display section shown in FIG. 1.

FIG. 3 illustrates an example of a circuit diagram of the liquid crystal display section 30. The liquid crystal display section 30 includes the plurality of pixels Pix that are arranged in a matrix form. Each of the pixels Pix includes three (red, green and blue) subpixels SPix. Each of the subpixels SPix has a TFT (thin-film transistor) element Tr and liquid crystal element LC. The TFT element Tr includes a thin film transistor. In this example, the TFT element Tr includes an n-channel MOS (Metal Oxide Semiconductor) TFT. The TFT element Tr has its source connected to a data line SGL, its gate connected to a gate line GCL and its drain connected to one end of the liquid crystal element LC. The liquid crystal element LC has one of its ends connected to the drain of the TFT element Tr and the other end grounded. The gate line GCL is connected to the gate driver 22, and the data line SGL to the data driver 23.

The backlight 40 emits light based on a drive signal supplied from the backlight drive section 9 and directs it to the liquid crystal display section 30.

Figure 4:
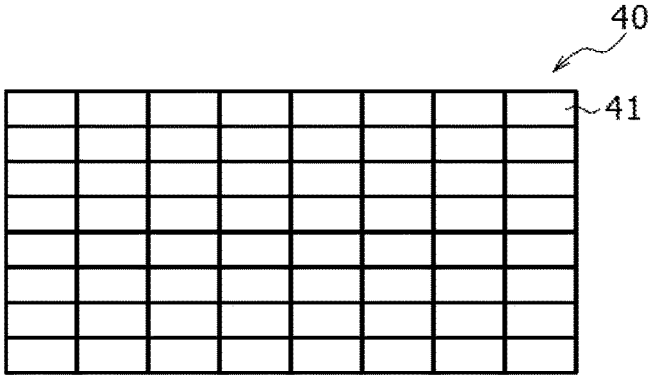
FIG. 4 is an explanatory diagram illustrating a configuration example of a backlight shown in FIG. 1.

FIG. 4 illustrates a configuration example of the backlight 40. The backlight 40 is a so-called direct backlight having a plurality of partial light-emitting sections 41 arranged in a matrix form. Each of the partial light-emitting sections 41 includes an LED (Light Emitting Diode) in this example. It should be noted that the lamp making up the partial light-emitting section 41 is not limited to an LED. For example, a CCFL (Cold Cathode Fluorescent Lamp) may be used instead. The partial light-emitting sections 41 can each emit light independently of each other at the set luminance. Light emitted from each of the partial light-emitting sections 41 passes through the associated area (partial display area 31 which will be described later) of the liquid crystal display section 30 and is emitted from the display device 1.

(Signal Processing Section 10)

A detailed description will be given next of the signal processing section 10.

The signal processing section 10 includes a peak level detection portion 11, peak level correction portion 12, signal correction portion 13 and luminance setting portion 14.

The peak level detection portion 11 detects a peak level PL representing the highest luminance of all the levels of the video signal Sdisp for each of the subpixels SPix.

Figure 5:
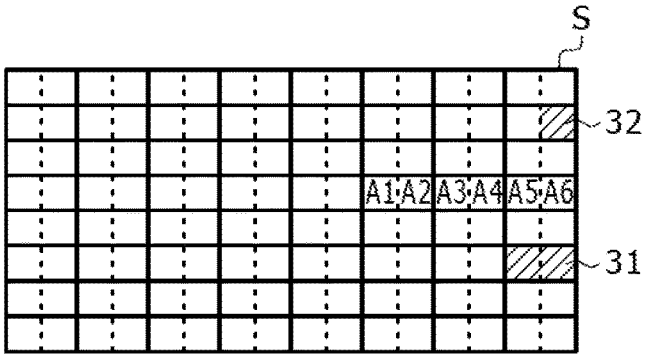
FIG. 5 is an explanatory diagram illustrating a display screen shown in FIG. 1.

FIG. 5 schematically illustrates a display screen S of the display device 1. The display screen S is divided into the partial display areas 31 that are arranged in a matrix form. Each of the partial display areas 31 is associated with one of the partial light-emitting sections 41 of the backlight 40. That is, light emitted from each of the partial light-emitting sections 41 passes through the associated partial display area 31. Further, each of the partial display areas 31 is divided into a plurality of unit areas 32 (two unit areas 32 in this case).

The peak level detection portion 11 detects the peak level PL of the video signal Sdisp for each of the partial display areas 31. The peak level PL is normalized so that the minimum signal level is "0," and the maximum signal level is "1." Here, the term "minimum signal level" refers to the level of the video signal Sdisp that provides the minimum luminous transmittance (so-called black level) of the liquid crystal element LC, and the term "maximum signal level" to the level of the video signal Sdisp that provides the maximum luminous transmittance (so-called white level) of the liquid crystal element LC. Then, the peak level detection portion 11 supplies, to the peak level correction portion 12, the position of the unit area 32, i.e., one of the two unit areas 32 belonging to that partial display area 31, where the peak level PL has been detected, together with the detected peak level PL for each of the partial display areas 31.

The peak level correction portion 12 corrects the peak level PL based on the peak level PL and a peak position PP supplied from the peak level detection portion 11, thus generating a peak level PL2. The peak level correction portion 12 has a correction data map MAP as illustrated in FIG. 1 and corrects the peak level PL using the correction data map MAP.

Figure 6:
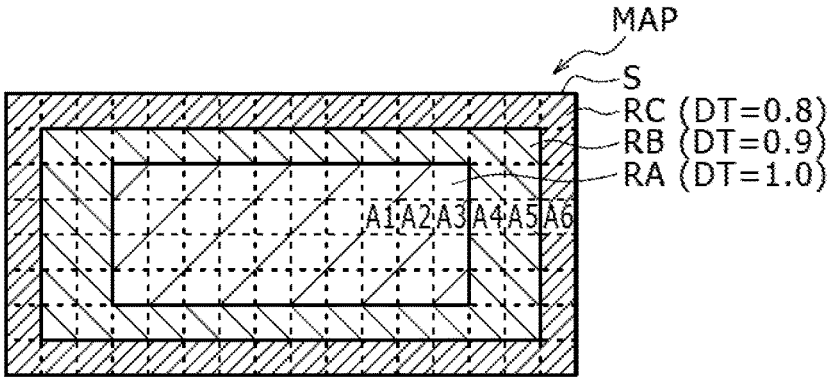
FIG. 6 is an explanatory diagram illustrating an example of a correction data map shown in FIG. 1.

FIG. 6 illustrates an example of the correction data map MAP. The correction data map MAP represents a map of correction data DT in the display screen S. The correction data DT is set for each of the unit areas 32.

In this example, three areas RA to RC are provided in the correction data map MAP. The areas RA to RC have different values as the correction data DT. The area RA is provided at and near the center of the display screen S. The area RB is provided to surround the area RA. The area RC is provided on the outside of the area RB. The correction data DT is set to "1.0" in the area RA, to "0.9" in the area RB, and to "0.8" in the area RC.

The peak level correction portion 12 corrects the peak level PL using the correction data map MAP based on the peak level PL and peak position PP for each of the partial display areas 31 supplied from the peak level detection portion 11. More specifically, the peak level correction portion 12 acquires the correction data DT in the unit area 32 indicated by the peak position PP using the correction data map MAP first as will be described later. Then, the peak level correction portion 12 multiplies the correction data DT by the peak level PL in the partial display area 31 including that unit area 32, thus correcting the peak level PL and generating the peak level PL2. Then, the peak level correction portion 12 finds a gain factor G1 using a function F1 based on the peak level PL2, thus supplying the gain factor G1 to the signal correction portion 13. Here, the function F1 increases the gain factor G1 as the peak level PL2 decreases. Similarly, the peak level correction portion 12 finds a luminance factor G2 using a function F2 based on the peak level PL2. Here, the function F2 increases the luminance factor G2 as the peak level PL2 increases. It should be noted that although the functions F1 and F2 are used in this example, the present disclosure is not limited to these functions. Instead, a LUT (Look Up Table), for example, may be used.

The signal correction portion 13 corrects the level of the video signal Sdisp for each of the partial display areas 31 based on the gain factor G1 of the partial display areas 31, thus outputting it as the video signal Sdisp2. More specifically, the signal correction portion 13 multiplies the level of the video signal Sdisp by the gain factor G1 for each of the partial display areas 31, thus correcting the level of the video signal Sdisp as will be described later.

The luminance setting portion 14 sets the luminance of each of the partial light-emitting sections 41 of the backlight 40 based on the luminance factor G2 of each of the partial display areas 31. More specifically, the luminance setting portion 14 sets the partial light-emitting section 41 associated with the partial display area 31 to a luminance proportional to the luminance factor G2 as will be described later.

Here, the correction data map MAP corresponds to a specific example of a "data map" in the present disclosure, and the correction data DT to a specific example of "factor data." The signal processing section 10 corresponds to a specific example of a "processing section" in the present disclosure. The areas RA to RC correspond to specific examples of "factor data areas" in the present disclosure, and the area RA to a specific example of a "specific factor data area."

[Operation and Action]

A description will be given next of the operation and action of the display device 1 according to the present embodiment.

(Outline of the Overall Operation)

First, the overall operation of the display device 1 will be outlined with reference to FIG. 1. The signal processing section 10 generates the video signal Sdisp2 and sets the luminance of each of the partial light-emitting sections 41 of the backlight 40 based on the video signal Sdisp. More specifically, the peak level detection portion 11 detects the peak level PL and peak position PP of the video signal Sdisp for each of the partial display areas 31. The peak level correction portion 12 generates the peak level PL2 by correcting the peak level PL using the correction data map MAP based on the peak level PL and peak position PP, thus finding the gain factor G1 and luminance factor G2 based on the peak level PL2. The signal correction portion 13 corrects the video signal Sdisp for each of the partial display areas 31 based on the gain factor G1, thus generating the video signal Sdisp2. The luminance setting portion 14 sets the luminance of each of the partial light-emitting sections 41 of the backlight 40 based on the luminance factor G2.

The display drive section 20 drives the liquid crystal display section 30. The liquid crystal display section 30 displays an image by modulating light emitted from the backlight 40. The backlight drive section 9 drives the backlight 40. Each of the partial light-emitting sections 41 of the backlight 40 emits light based on a drive signal supplied from the backlight drive section 9 and directs it to the liquid crystal display section 30.

(Operation of the Signal Processing Section 10)

A detailed description will be given next of the operation of the signal processing section 10.

Figure 7:
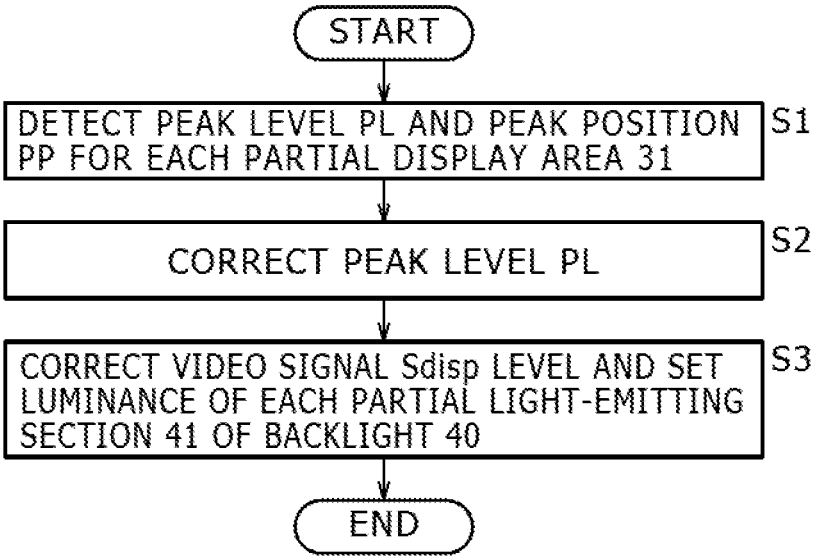
FIG. 7 is a flowchart illustrating an operation example of a signal processing section shown in FIG. 1.

FIG. 7 illustrates an operation example of the signal processing section 10. The signal processing section 10 detects the peak level PL of the supplied video signal Sdisp for each of the partial display areas 31 first, and then generates the peak level PL2 by correcting the peak level PL using the correction data map MAP, thus finding the gain factor G1 and luminance factor G2 based on the peak level PL2. Then, the signal processing section 10 corrects the video signal Sdisp based on the gain factor G1 and sets the luminance of the partial light-emitting section 41 associated with that partial display area 31 based on the luminance factor G2. A detailed description thereof will be given below.

First, the peak level detection portion 11 of the signal processing section 10 detects the peak level PL and peak position PP of the video signal Sdisp for each of the partial display areas 31 (step S1).

Figure 8:
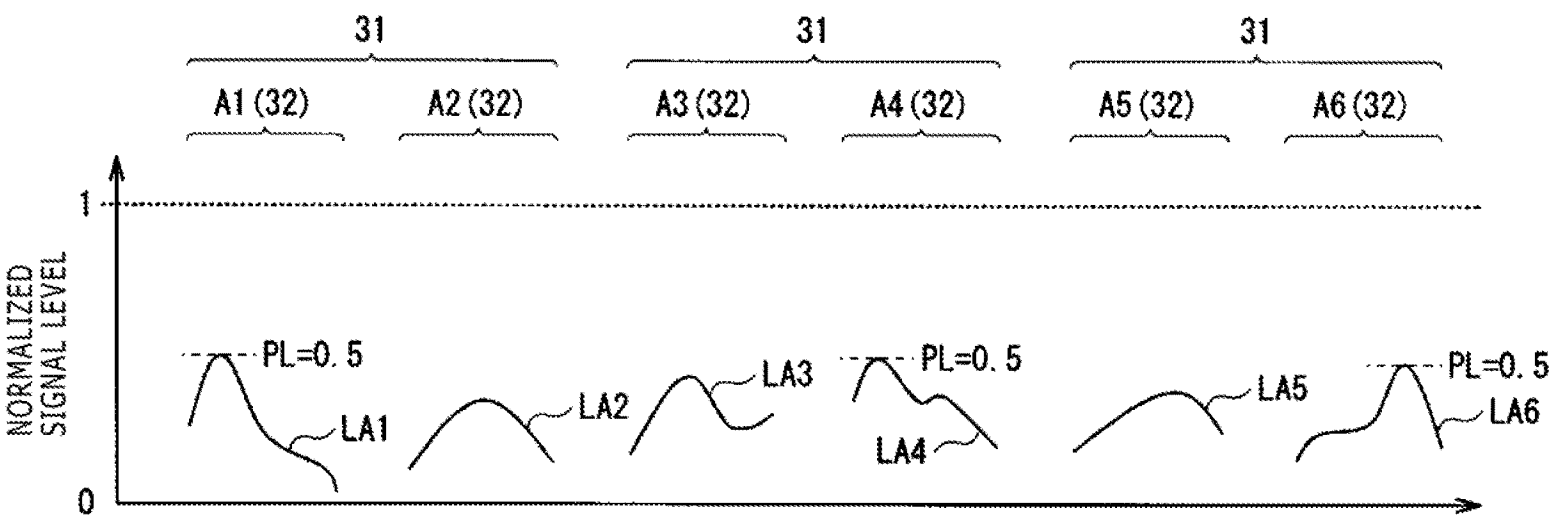
FIG. 8 is a schematic diagram illustrating an operation example of a peak level detection portion shown in FIG. 1.

FIG. 8 schematically illustrates examples of normalized signal levels LA1 to LA6 of the video signal Sdisp in unit areas A1 to A6 shown in FIG. 5. In the curves with signal levels LA1 to LA6, the horizontal axis represents all the subpixels SPix respectively belonging to the unit areas A1 to A6. That is, the curves having the signal levels LA1 to LA6 represent the signal levels of all the subpixels SPix belonging to the unit areas A1 to A6, respectively.

In the example shown in FIG. 8, the maximum value of the signal levels LA1 and LA2 is, for example, 0.5 (peak level PL) in the partial display area 31 that includes the unit areas A1 and A2. The unit area 32 having this maximum value is the unit area A1 (peak position PP).

On the other hand, the maximum value of the signal levels LA3 and LA4 is, for example, 0.5 (peak level PL) in the partial display area 31 that includes the unit areas A3 and A4. The unit area 32 having this maximum value is the unit area A4 (peak position PP).

Similarly, the maximum value of the signal levels LA5 and LA6 is, for example, 0.5 (peak level PL) in the partial display area 31 that includes the unit areas A5 and A6. The unit area 32 having this maximum value is the unit area A6 (peak position PP).

The peak level detection portion 11 detects the peak level PL and peak position PP in all the partial display areas 31 as described above. It should be noted that the peak levels PL are all 0.5 as shown above for reasons of convenience in this example. However, the present disclosure is not limited thereto. Instead, the peak levels may take on any value between 0 and 1.

Next, the peak level correction portion 12 of the signal processing section 10 corrects the peak level PL detected by the peak level detection portion 11 (step S2). More specifically, the peak level correction portion 12 acquires the correction data DT in the unit area 32 indicated by the peak position PP using the correction data map MAP first. Then, the peak level correction portion 12 multiplies the correction data DT by the peak level PL in the partial display area 31, thus correcting the peak level PL and generating the peak level PL2.

In the partial display area 31 that includes the unit areas A1 and A2, for example, the peak position PP is the unit area A1. Therefore, the peak level correction portion 12 acquires the correction data DT (1.0) in this unit area A1 by using the correction data map MAP (FIG. 6). That is, the peak position PP (unit area A1) in the partial display area 31 belongs to the area RA. Then, the peak level correction portion 12 multiplies the correction data DT by the peak level PL (0.5), thus generating the peak level PL2 (0.5=1.0×0.5).

In the partial display area 31 that includes the unit areas A3 and A4, on the other hand, the peak level correction portion 12 acquires the correction data DT (0.9) in the peak position PP (unit area A4). That is, the peak position PP (unit area A4) in this partial display area 31 belongs to the area RB. Then, the peak level correction portion 12 generates the peak level PL2 (0.45=0.9×0.5) based on this correction data DT and peak level PL (0.5).

Similarly, in the partial display area 31 that includes the unit areas A5 and A6, the peak level correction portion 12 acquires the correction data DT (0.8) in the peak position PP (unit area A6). That is, the peak position PP (unit area A6) in this partial display area 31 belongs to the area RC. Then, the peak level correction portion 12 generates the peak level PL2 (0.4=0.8×0.5) based on this correction data DT and peak level PL (0.5).

The peak level correction portion 12 corrects the peak level PL in all the partial display areas 31 as described above, thus generating the peak level PL2.

Next, the signal processing section 10 corrects the level of the video signal Sdisp and sets the luminance of each of the partial light-emitting sections 41 of the backlight 40 (step S3).

Figure 9A:
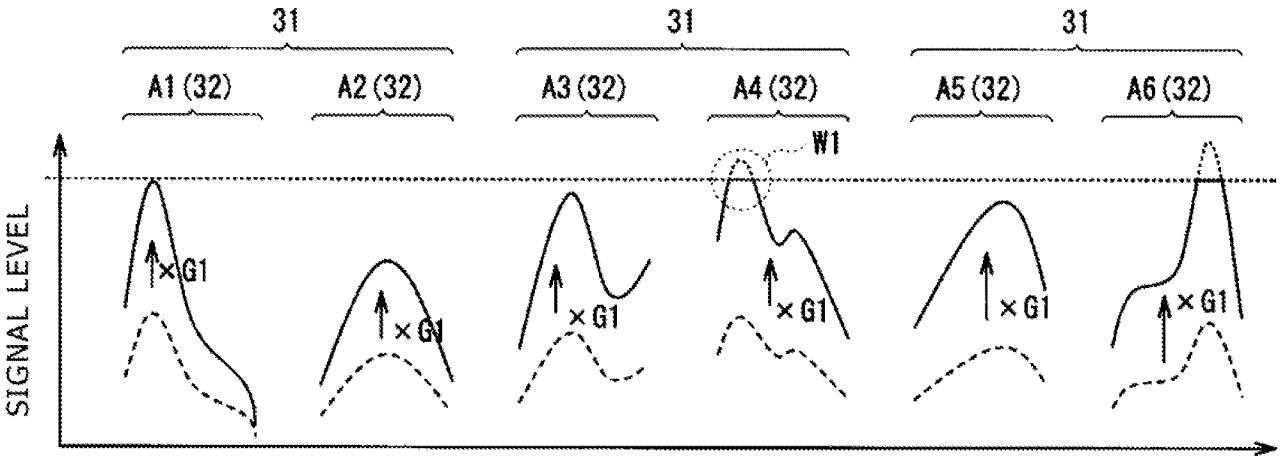
FIGS. 9A and 9B are schematic diagrams illustrating an operation example of a peak level correction portion shown in FIG. 1.
Figure 9B:
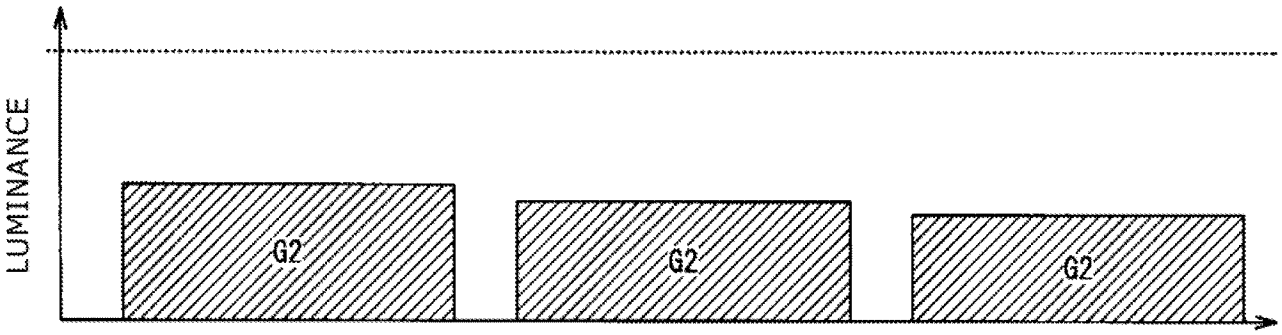

FIGS. 9A and 9B illustrate an example of the process performed in step S3 if the signal levels are as shown in FIG. 8. FIG. 9A illustrates the correction of the level of the video signal Sdisp, and FIG. 9B the setting of the luminance of the partial light-emitting sections 41.

The peak level correction portion 12 of the signal processing section 10 finds the gain factor G1 using the function F1 based on the peak level PL2 and also finds the luminance factor G2 using the function F2 for each of the partial display areas 31. Then, the signal correction portion 13 of the signal processing section 10 multiplies the level of the video signal Sdisp by the gain factor G1 for each of the partial display areas 31 as illustrated in FIG. 9A, thus correcting the level of the video signal Sdisp. Further, the luminance setting portion 14 of the signal processing section 10 sets the partial light-emitting sections 41, each associated with one of the partial display areas 31, to a luminance proportional to the luminance factor G2 as illustrated in FIG. 9B.

In the partial display area 31 that includes the unit areas A1 and A2, for example, the signal correction portion 13 multiplies the level of the video signal Sdisp by the gain factor G1 associated with the peak level PL2 (0.5) (FIG. 9A). Further, the luminance setting portion 14 sets the associated partial light-emitting section 41 to a luminance proportional to the luminance factor G2 associated with the peak level PL2 (0.5) (FIG. 9B).

In the partial display area 31 that includes the unit areas A3 and A4, on the other hand, the signal correction portion 13 multiplies the level of the video signal Sdisp by the gain factor G1 associated with the peak level PL2 (0.45) (FIG. 9A). Further, the luminance setting portion 14 sets the associated partial light-emitting section 41 to a luminance proportional to the luminance factor G2 associated with the peak level PL2 (0.45) (FIG. 9B). The peak level PL2 (0.45) in the unit areas A3 and A4 is smaller than that (0.5) in the unit areas A1 and A2. Therefore, the gain factor G1 in the unit areas A3 and A4 is greater than that in the unit areas A1 and A2, and the luminance factor G2 in the unit areas A3 and A4 is smaller than that in the unit areas A1 and A2.

Similarly, in the partial display area 31 that includes the unit areas A5 and A6, for example, the signal correction portion 13 multiplies the level of the video signal Sdisp by the gain factor G1 associated with the peak level PL2 (0.4) (FIG. 9A). Further, the luminance setting portion 14 sets the associated partial light-emitting section 41 to a luminance proportional to the luminance factor G2 associated with the peak level PL2 (0.4) (FIG. 9B). The peak level PL2 (0.4) in the unit areas A5 and A6 is smaller than that (0.45) in the unit areas A3 and A4. Therefore, the gain factor G1 in the unit areas A5 and A6 is greater than that in the unit areas A3 and A4, and the luminance factor G2 in the unit areas A5 and A6 is smaller than that in the unit areas A3 and A4.

The signal processing section 10 corrects the level of the video signal Sdisp in all the partial display areas 31 and sets the luminance of each of all the partial light-emitting sections 41 as described above.

This ends the flow. The signal processing section 10 processes each frame image supplied via the video signal Sdisp as described above.

Thus, the luminance of the associated partial light-emitting section 41 is set according to the level of the video signal Sdisp for each of the partial display areas 31 in the display device 1. As a result, the lower the level of the video signal Sdisp (peak level PL), the more the luminance of the partial light-emitting section 41 can be reduced, thus contributing to reduced power consumption of the backlight 40.

A description will be given next of the action of the correction data map MAP. The correction data map MAP has the three areas RA to RC provided therein that differ in the correction data DT from each other.

In the partial display area 31 whose peak position PP is detected in the area RA, the correction data DT is 1.0. Therefore, the luminance of the associated partial light-emitting section 41 can be reduced without degrading the image quality. That is, in the partial display area 31 that includes the unit areas A1 and A2 (on the left in FIGS. 8, 9A and 9B), for example, the signal levels are multiplied by the gain factor G1 for correction, and the luminance of the partial light-emitting sections 41 is set to be proportional to the luminance factor G2. At this time, the corrected signal levels do not exceed the so-called white level (FIG. 9A). This prevents the degradation of the image quality, thus contributing to reduced power consumption without degrading the image quality.

In the partial display area 31 whose peak position PP is detected in the area RB, the correction data DT is 0.9. Therefore, the luminance of the associated partial light-emitting section 41 can be further reduced although the image quality declines to a small extent. That is, in this partial display area 31, the corrected signal level for some of the subpixels SPix exceeds the white level and is saturated (portion W1 in FIG. 9A). In this case, the luminance of the subpixel SPix is lower than the desired one and not sufficient. Further, if, for example, the signal level of only the subpixel SPix of a certain color is saturated, a so-called color shift occurs. If the corrected signal level is saturated as described above, the image quality may degrade due to insufficient luminance or color shift. However, the area RB is provided to surround the area RA that is provided at and near the center of the display screen S (FIG. 6). Therefore, it is unlikely that the area RB will attract more attention of the viewer than the area RA. Therefore, even if a color shift or other problem occurs in the partial display areas 31 of the area RB, it is unlikely that the viewer will perceive the degradation of image quality. On the other hand, the luminance of the partial light-emitting sections 41 of the area RB can be reduced more than that of the partial light-emitting sections 41 of the area RA (FIG. 9B), thus contributing to reduced power consumption.

Similarly, in the partial display area 31 whose peak position PP is detected in the area RC, the correction data DT is 0.8. Therefore, the luminance of the associated partial light-emitting section 41 can be reduced more than that of the partial display area 31 of the area RA although the image quality declines to a small extent, thus contributing to reduced power consumption.

As described above, the display device 1 has the correction data map MAP that permits adjustment of the extent to which power consumption is reduced for each of the areas RA to RC. That is, in the area RA that is provided at and near the center of the display screen S and that is most likely to attract the attention of the viewer, the power consumption is reduced without degrading the image quality. In the areas RB and RC that are provided to surround the area RA and that are less likely to attract the attention of the viewer, the power consumption is further reduced at the somewhat expense of image quality. As a result, the display device 1 provides reduced power consumption in an effective manner while at the same time minimizing the likelihood of the viewer perceiving the degradation of image quality.

[Effect]

As described above, a correction data map is provided in the present embodiment, thus permitting adjustment of the extent of power consumption for each partial display area and providing a high degree of freedom in power control.

Each of the partial display areas is divided into a plurality of unit areas in the present embodiment so that a different piece of correction data can be set for each of the unit areas. This makes it possible to set the shapes of the areas RA to RC with more freedom without being limited by the size of the partial display area or partial light-emitting section.

Further, in the present embodiment, the farther away from the center of the display screen, the higher the extent to which the power consumption is reduced. This provides reduced power consumption in an effective manner while at the same time minimizing the likelihood of the viewer perceiving the degradation of image quality.

Modification Example 1-1

In the above example, the correction data DT was set to 1, 0.9 and 0.8 respectively in the areas RA to RC. However, the values of the correction data DT are not limited thereto. Alternatively, the correction data DT may be set to values with smaller differences between them such as 1, 0.95 and 0.9. Still alternatively, the correction data DT may be set to values with varying differences between them such as 1, 0.9 and 0.85.

Figure 10A:
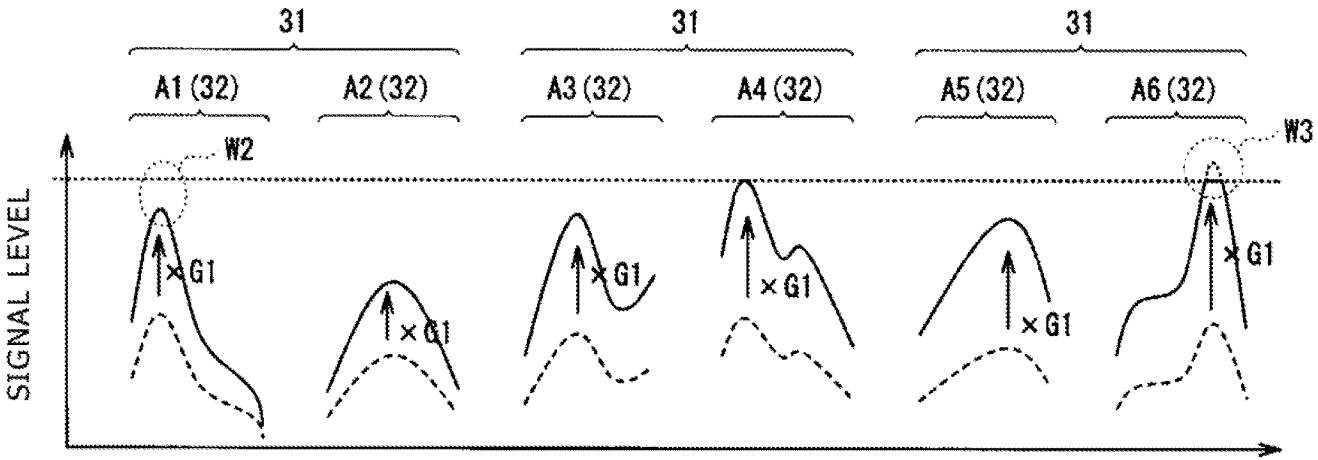
FIGS. 10A and 10B are schematic diagrams illustrating an operation example of the peak level correction portion according to a modification example of the first embodiment.
Figure 10B:
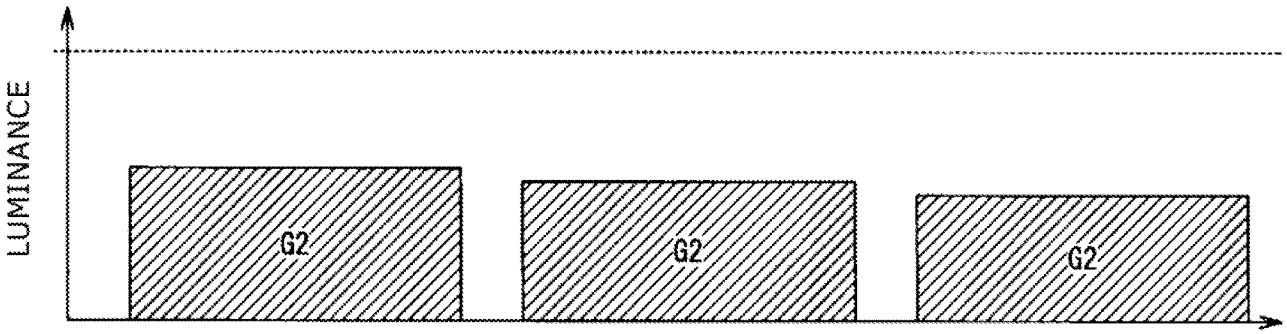

Further, the correction data DT in the area RA is not limited to 1. Alternatively, the correction data DT may be, for example, set to 1.1, 1 and 0.9. FIGS. 10A and 10B illustrate an example of the process performed in this case by the signal processing section 10 in step S3. As is obvious by comparison with the above embodiment (FIGS. 9A and 9B), the present modification example (FIGS. 10A and 10B) provides slightly reduced corrected signal levels and slightly higher luminance of the partial light-emitting section 41. More specifically, in the partial display area 31 of the area RA (on the left in FIG. 10A), there is a margin between the maximum value of the corrected signal level and the white level (portion W2). Further, although part of the corrected signal level exceeds the white level (portion W3) in the partial display area 31 of the area RA (on the right in FIG.

10A), the excess beyond the white level is smaller than that in the above embodiment (FIGS. 9A and 9B). That is, the present modification example provides improved image quality as compared to the above embodiment.

Further, although the three areas RA to RC are provided in the above embodiment, the present disclosure is not limited thereto. Alternatively, two areas may be provided. Still alternatively, four or more areas may be provided.

Modification Example 1-2

In the above embodiment, the direct backlight 40 is used. However, the present disclosure is not limited thereto. Instead, an edge-light backlight, for example, may be used. A description will be given below of a display device 1B having an edge-light backlight 40B.

Figure 11:
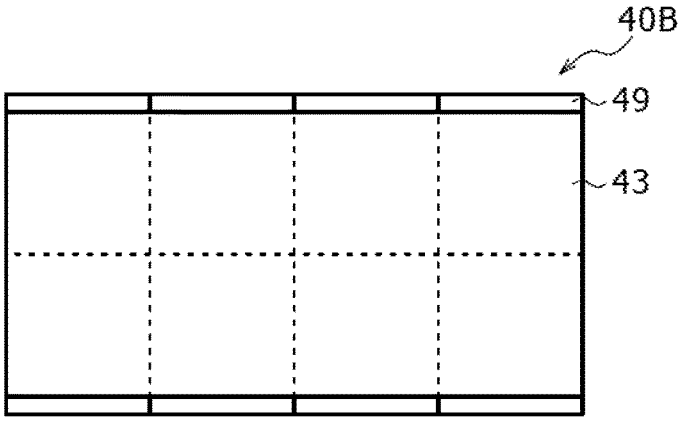
FIG. 11 is an explanatory diagram illustrating a configuration example of the backlight according to another modification example of the first embodiment.

FIG. 11 illustrates a configuration example of the edge-light backlight 40B. The backlight 40B has a plurality of (four in this example) light sources 49 on the top and bottom sides of the display screen S. Light emitted from each of these light sources 49 is guided onto the entire surface of an associated partial light-emitting section 43 by a light guide plate and emitted to the liquid crystal display section 30.

Figure 12:
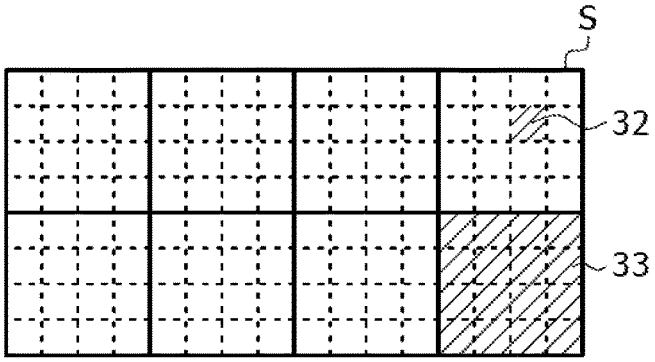
FIG. 12 is an explanatory diagram illustrating the display screen according to the another modification example of the first embodiment.

FIG. 12 schematically illustrates the display screen S of the display device 1B. The display screen S is divided into a plurality of partial display areas 33 each of which is associated with one of the partial light-emitting sections 43 (FIG. 11) of the backlight 40B. Further, each of the partial display areas 33 is divided into the plurality of unit areas 32 (16 unit areas 32 in this case).

In this case, the same advantageous effect as with the display device 1 according to the above embodiment can be achieved by using, for example, the correction data map MAP shown in FIG. 6.

Modification Example 1-3

Figure 13:
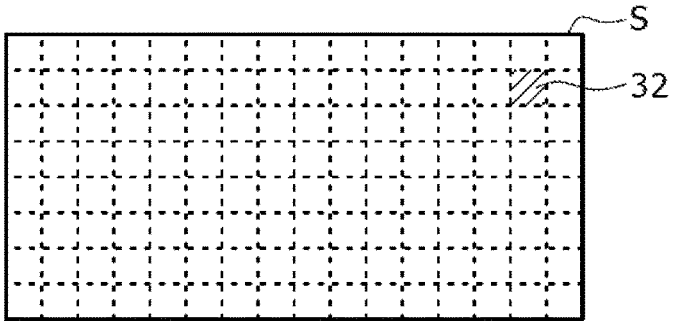
FIG. 13 is an explanatory diagram illustrating the display screen according to still another modification example of the first embodiment.

In the above embodiment, the backlight 40 having the plurality of partial light-emitting sections 41 is used. However, the present disclosure is not limited thereto. Instead, a backlight including a single light-emitting section may be used. In this case, the display screen S is divided into the plurality of unit areas 32 as illustrated in FIG. 13. Even in this case, the same advantageous effect as with the display device 1 according to the above embodiment can be achieved by using, for example, the correction data map MAP shown in FIG. 6.

Modification Example 1-4

In the above embodiment, the correction data map MAP is fixed. However, the present disclosure is not limited thereto. Instead, the correction data map MAP may be prepared in such a manner as to be changed according to the operation mode. For example, if the display device 1 is applied to a television receiver, the correction data DT may be set to 1, 0.9 and 0.8 respectively in the areas RA to RC in so-called home use mode, and to 1 in all the areas RA to RC in image quality priority mode. Further, not only the correction data DT but also the layout of the areas RA to RC in the display screen S and the number thereof may be changed.

Still further, the correction data map may be prepared in such a manner as to be changed according to the video source content. A description will be given below of a display device 1F according to the present modification example.

Figure 14:
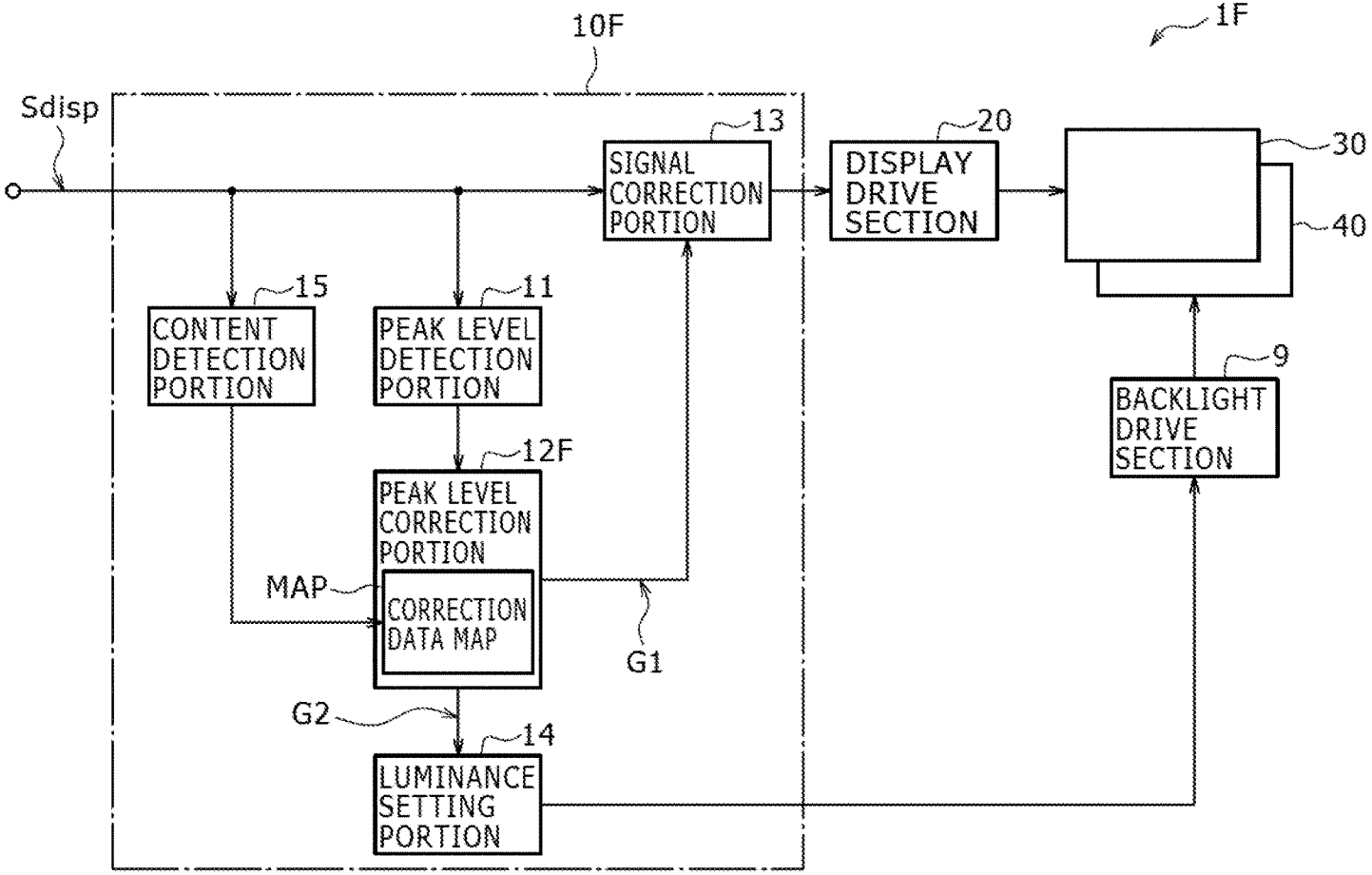
FIG. 14 is a block diagram illustrating a configuration example of the display device according to still another modification example of the first embodiment.

FIG. 14 illustrates a configuration example of the display device 1F. The display device 1F includes a signal processing section 10F. The signal processing section 10F includes a content detection portion 15 and peak level correction portion 12F. The content detection portion 15 detects content based on content information (e.g., information representing genres such as sports, news, cinemas and animations). The peak level correction portion 12F can change the correction data map MAP based on the detection result of the content detection portion 15. More specifically, the peak level correction portion 12F selects the correction data map MAP suitable for the content from among the plurality of preset correction data maps MAP. The correction data map MAP used to display a sport program may be, for example, as shown in FIG. 6. Further, the correction data map MAP used to display a cinema program may be, for example, that in which the correction data DT is set to 1 for all the areas RA to RC. It should be noted that the content detection portion 15 detects content based on content information contained in the video signal Sdisp. However, the present disclosure is not limited thereto. Instead, content may be detected, for example, based on an EPG (Electronic Program Guide).

2. Second Embodiment

A description will be given next of a display device 2 according to a second embodiment. In the present embodiment, each of the partial display areas 31 is not divided into the plurality of unit areas 32 so that each partial display area is associated one-to-one with a unit area. It should be noted that the components that are substantially the same as those of the display device 1 according to the first embodiment are denoted by the same reference symbols, and that the description thereof will be omitted as appropriate.

The display device 2 according to the present embodiment includes a signal processing section 60 as illustrated in FIG. 1. The signal processing section 60 includes a peak level detection portion 61 and peak level correction portion 62.

Figure 15A:
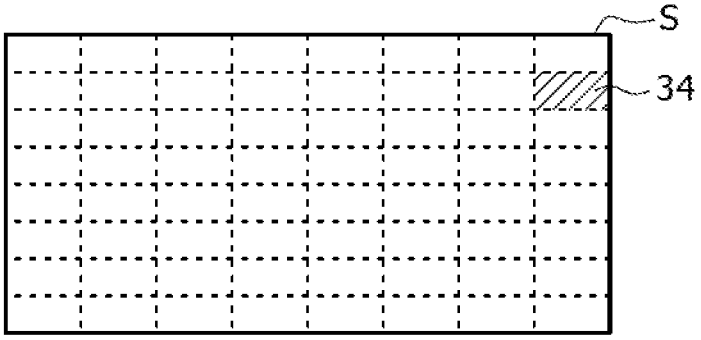
FIGS. 15A and 15B are explanatory diagrams illustrating an example of a display screen and correction data map according to a second embodiment.
Figure 15B:
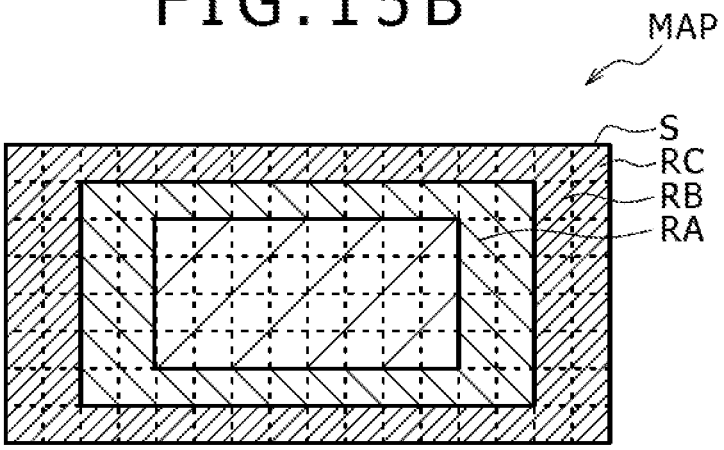

FIG. 15A schematically illustrates the display screen S of the display device 2, and FIG. 15B an example of the correction data map MAP. The display screen S of the display device 2 is divided into partial display areas 34 that are arranged in a matrix form as illustrated in FIG. 15A. Each of the partial display areas 34 is associated with one of the partial light-emitting sections 41 of the backlight 40. Unlike the display device 1 according to the first embodiment, each of the partial display areas 34 is not divided into a plurality of unit areas. Therefore, each of the partial display areas 34 is associated one-to-one with a unit area. The correction data DT is set for each of the unit areas 32. Further, in the correction data map MAP according to the display device 2, the correction data DT is set for each of the partial display areas (unit areas) 34 as illustrated in FIG. 15B.

The peak level detection portion 61 detects the peak level PL of the video signal Sdisp for each of the partial display areas 34, supplying the detection result to the peak level correction portion 62 together with a position PR of the partial display area 34. That is, unlike the peak level detection portion 11 according to the first embodiment, the peak level detection portion 61 supplies the position PR of the partial display area 34 rather than the peak position PP to the peak level correction portion 62.

The peak level correction portion 62 corrects the peak level PL using the correction data map MAP based on the peak level PL and position PR for each of the partial display areas 34 supplied from the peak level detection portion 61.

More specifically, the peak level correction portion 62 acquires the correction data DT in the partial display area (unit area) 34 indicated by the position PR first using the correction data map MAP. Then, the peak level correction portion 62 multiplies the correction data DT by the peak level PL in the partial display area 31 including that unit area 32, thus correcting the peak level PL and generating the peak level PL2. Then, the peak level correction portion 62 finds the gain factor G1 using the function F1 based on the peak level PL2 and also finds the luminance factor G2 using the function F2.

As described above, in the present embodiment, each of the partial display areas is associated one-to-one with a unit area. Therefore, even if a piece of hardware having poor arithmetic capability is used as the signal processing section, it is possible to provide a high degree of freedom in power control. Other advantageous effects of the present embodiment are the same as those of the first embodiment.

Modification Example 2-1

Any of modification examples 1-1, 1-2 and 1-4 of the first embodiment may be applied to the display device 2 according to the present embodiment.

3. Third Embodiment

A description will be given next of a display device 3 according to a third embodiment. In the present embodiment, the correction data map MAP can be dynamically changed based on the video signal Sdisp in the display device 1 according to the first embodiment. It should be noted that the components that are substantially the same as those of the display device 1 according to the first embodiment are denoted by the same reference symbols, and that the description thereof will be omitted as appropriate.

Figure 16:
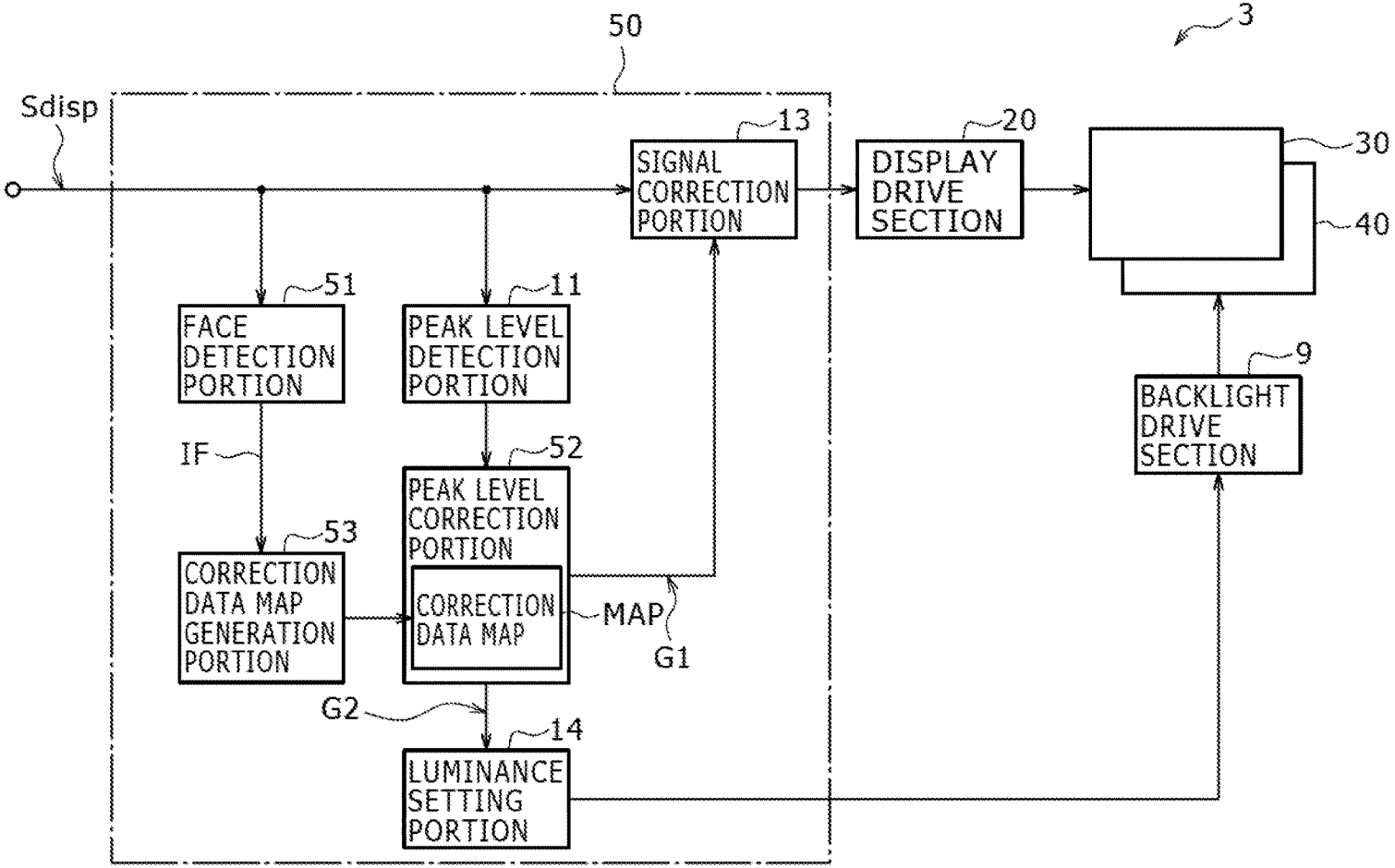
FIG. 16 is a block diagram illustrating a configuration example of a display device according to a third embodiment.

FIG. 16 illustrates a configuration example of the display device 3 according to the present embodiment. The display device 3 includes a signal processing section 50. The signal processing section 50 includes a face detection portion 51, correction data map generation portion 53 and peak level correction portion 52.

The face detection portion 51 detects a human face to be displayed on the display screen S and finds the position and size of the face in the display screen S based on the video signal Sdisp, thus supplying these pieces of information (face detection information IF) to the correction data map generation portion 53. The correction data map generation portion 53 generates the correction data map MAP based on the face detection information IF. The peak level correction portion 52 corrects the peak level PL detected by the peak level detection portion 11 using the correction data map MAP supplied from the correction data map generation portion 53, thus generating the peak level PL2 and finding the gain factor G1 and luminance factor G2 based on the peak level PL2.

Figure 17:
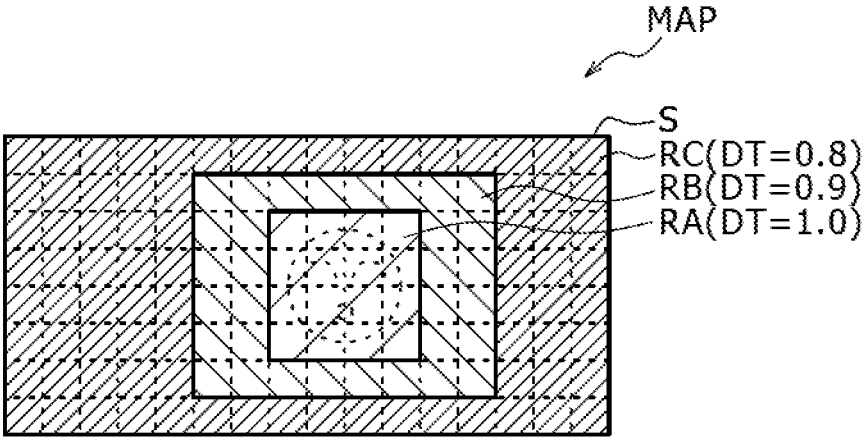
FIG. 17 is an explanatory diagram illustrating an example of a correction data map shown in FIG. 16.

FIG. 17 illustrates an example of the correction data map MAP according to the present embodiment. The correction data map generation portion 53 generates the correction data map MAP based on the face detection information IF. More specifically, the correction data map generation portion 53 sets the area associated with the detected face as the area RA, sets the area RB in such a manner as to surround the area RA and sets the area other than the areas RA and RB as the area RC, thus generating the correction data map MAP.

The correction data DT is set to "1.0" in the area RA, to "0.9" in the area RB, and to "0.8" in the area RC as in the first embodiment. That is, the power consumption of the partial display areas 31 of the area RA can be reduced without degrading the image quality. On the other hand, the power consumption of the partial display areas 31 of the areas RB and RC can be further reduced at the somewhat expense of image quality.

As described above, the display device 3 detects a human face to be displayed on the display screen S based on the video signal Sdisp, thus setting the area associated with the detected face as the area RA. That is, if the viewer watches, for example, a drama, it is generally likely that the face of the displayed person will attract the attention of the viewer. Further, it is more likely that a color shift, for example, will appear unnatural to the viewer when the face of a person is displayed than when an object is displayed. Therefore, the display device 3 detects a human face and sets the display area thereof as the area RA, thus making it possible to display the face without degrading the image quality.

Further, the display device 3 sets the areas RB and RC in such a manner as to surround the face display area. That is, it is likely that the human face will attract the attention of the viewer as described above, and it is unlikely that the areas other than the face will attract the attention of the viewer. Therefore, it is unlikely that the viewer will perceive the degradation of image quality even in the event of a color shift in any of the areas other than the face. Therefore, the display device 3 sets the areas other than the face display area as the areas RB and RC, providing reduced power consumption in an effective manner while at the same time minimizing the likelihood of the viewer perceiving the degradation of image quality.

As described above, in the present embodiment, a correction data map is dynamically generated based on a video signal, thus providing a high degree of freedom in power control according to the display content.

Further, the face detection section is provided in the present embodiment so that the area showing a face is displayed with high image quality, and that the power consumption of other areas is reduced, thus providing reduced power consumption in an effective manner while at the same time minimizing the likelihood of the viewer perceiving the degradation of image quality.

Other advantageous effects of the present embodiment are the same as those of the first embodiment.

Modification Example 3-1

A human face to be displayed on the display screen S is detected in the above embodiment. However, the present disclosure is not limited thereto. Instead or in addition thereto, subtitles and telops, for example, may be detected. This makes it possible to display subtitles and telops, i.e., information that is likely to attract the attention of the viewer, without degrading the image quality.

Modification Example 3-2

In the above embodiment, what is likely to attract the attention of the viewer is detected, and the display area thereof is set as the area RA. However, the present disclosure is not limited thereto. Instead, what is unlikely to attract the attention of the viewer may be detected so that the display area thereof is set as the area RC. More specifically, if the display device 3 is used, for example, for a TV conference system, the display area of one's own face can be set as the area RC. This makes it possible to display the area showing the face of the party on the other end with high image quality and reduce the power consumption of the area showing one's own face at the expense of image quality.

Modification Example 3-3

Any of modification examples 1-1 to 1-4 of the first embodiment may be applied to the display device 3 according to the present embodiment.

Modification Example 3-4

In the above embodiment, the correction data map MAP can be dynamically changed in the display device 1 according to the first embodiment. However, the present disclosure is not limited thereto. The correction data map MAP can be dynamically changed in the display device 2 according to the second embodiment.

Thus, the present technology has been described by citing several embodiments and modification examples. However, the present technology is not limited to these embodiments and may be modified in various ways.

Figure 18:
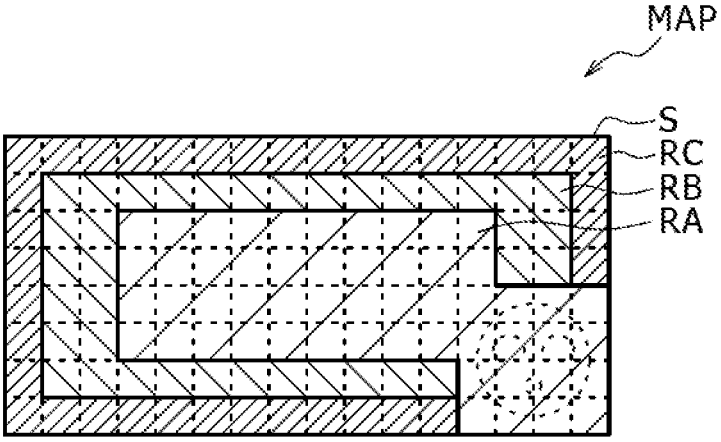
FIG. 18 is an explanatory diagram illustrating an example of the correction data map according to a modification example.

In the third embodiment, for example, the position of the detected face is set as the area RA, and the areas RB and RC are set in such a manner as to surround the face display area. However, the present disclosure is not limited thereto. For example, the area in which a face is detected may also be set as the area RA in the correction data map MAP (for example, FIG. 6) according to the first and second embodiments as illustrated in FIG. 18. As a result, the display device 3 operates in the same manner as the display devices 1 and 2 according to the first and second embodiments if no face is displayed on the display screen S. On the other hand, if a face is displayed on the display screen S, the power consumption of the area showing the face can be reduced in an effective manner without degrading the image quality.

It should be noted that the present technology may have the following configurations.

(1) A display device including:

a liquid crystal display section adapted to display an image based on a video signal;

a backlight; and a processing section adapted to correct the video signal and set the luminance of the backlight based on two pieces of information, a peak level of the video signal in a display screen or in each of a plurality of partial display areas into which the display screen is divided, and factor data obtained from a data map made up of a reference position on the display screen and the factor data that are associated with each other.

(2) The display device of feature (1), in which the peak level is a peak level of an image to be displayed in each of the partial display areas, and the processing section uses the data map to set a position on the display screen where the peak level occurs in each of the partial display areas as the reference position so as to acquire factor data associated with the reference position.

(3) The display device of feature (1), in which the peak level is a peak level of an image to be displayed in each of the partial display areas, and the processing section uses the data map to set a position on the display screen in each of the partial display areas as the reference position so as to acquire factor data associated with the reference position.

(4) The display device of feature (2) or (3), in which the backlight has a plurality of partial light-emitting sections each of which is associated with one of the partial display areas, and the processing section corrects the video signal for each of the partial display areas and sets the luminance of the associated partial light-emitting section based on the peak level and factor data.

(5) The display device of feature (1), in which the peak level is a peak level of an image to be displayed on the display screen, and the processing section uses the data map to set a position on the display screen where the peak level occurs as the reference position so as to acquire factor data associated with the reference position.

(6) The display device of any one of features (1) to (5), in which the data map is divided into a plurality of factor data areas that differ in the factor data from each other.

(7) The display device of feature (6), in which if the reference position belongs to a specific factor data area of the plurality of factor data areas, the processing section corrects the video signal so that the luminance of the backlight is set to a higher level and the transmittance of the liquid crystal display section is set to a lower level than if the reference position belongs to other factor data area.

(8) The display device of feature (7), in which the specific factor data area is provided at and near the center of the display screen.

(9) The display device of feature (7) including:

an image recognition section adapted to identify a predetermined image in the image to be displayed based on the video signal.

(10) The display device of feature (9), in which the specific factor data area is an area where the predetermined image has been identified.

(11) The display device of feature (9), in which the specific factor data area includes an area associated with the center and near the center of the display screen and the area where the predetermined image has been identified.

(12) The display device of any one of features (9) to (11), in which the predetermined image is a face image.

(13) The display device of any one of features (9) to (12), in which the predetermined image is an image of a portion of a displayed image that attracts much attention of a viewer.

(14) The display device of any one of features (7) to (13) including:

a data map generation section adapted to generate a data map containing the specific factor data.

(15) The display device of any one of features (1) to (14), in which the display device has a plurality of operation modes, and the processing section determines which data map to refer to according to the operation mode.

(16) The display device of any one of features (1) to (15), in which the processing section determines which data map to refer to according to content to be displayed.

(17) A display device including:

a liquid crystal display section adapted to display an image based on a video signal;

a backlight; and a processing section adapted to correct the video signal and set the luminance of the backlight based on two pieces of information, a peak level of the video signal in a display screen or in each of a plurality of partial display areas into which the display screen is divided, and a peak position, i.e., a position on the display screen where the peak level occurs.

(18) A display device including:

a liquid crystal display section adapted to display an image based on a video signal;

a backlight having a plurality of partial light-emitting sections; and a processing section adapted to correct the video signal and set the luminance of each of the partial light-emitting sections based on two pieces of information, a peak level of the video signal in a partial display area associated with one of the partial light-emitting sections, and a position of that partial display area.

(19) A display method including:

correcting a video signal and setting the luminance of a backlight based on two pieces of information, a peak level of the video signal in a display screen or in each of a plurality of partial display areas into which the display screen is divided, and factor data obtained from a data map made up of a position on the display screen and the factor data that are associated with each other so as to display an image based on the corrected video signal.

What is claimed is:

1. A display device comprising:

a liquid crystal display section to display an image based on a video signal on a display screen;

a backlight; and a processing section to correct the video signal and set luminance of the backlight based on two pieces of information, a peak level of the video signal in each of a plurality of partial display areas into which the display screen is divided, and factor data obtained from a data map made up of a respective reference position of said each partial display area on the display screen and the factor data that are associated with each other, the backlight having a plurality of partial light-emitting sections each having a respective light source so to enable each said partial light-emitting section to emit light independently of each other, each said partial light-emitting section being respectively associated with one of the partial display areas, and the processing section being configured to (i) obtain the respective peak level for said each partial display area, (ii) calculate a corrected peak level for said each partial display area by use of the respective peak level for said each partial display area and respective factor data which is associated with the respective reference position of the respective partial display area, and (iii) set for each of the partial light-emitting sections a luminance level according to the corrected peak level of the partial display area corresponding to the partial light-emitting section, wherein the processing section is configured to determine changes for the data map according to at least one of (i) an operation mode of a plurality of operation modes of the display device or (ii) content to be displayed.

2. The display device of claim 1, wherein the peak level is a peak level of an image to be displayed in each of the partial display areas.

3. The display device of claim 2, wherein the data map is divided into a plurality of factor data areas that differ in the factor data from each other.

4. The display device of claim 2 further comprising:

an image recognition section to identify a predetermined image in the image to be displayed based on the video signal.

5. The display device of claim 4, wherein the predetermined image is a face image.

6. The display device of claim 4, wherein the predetermined image is an image of a portion of a displayed image that is likely to attract attention of a viewer.

7. The display device of claim 3 further comprising:

a data map generation section to generate the data map containing the factor data.

8. A display device comprising:

a liquid crystal display section to display an image based on a video signal on a display screen;

a backlight; and a processing section to correct the video signal and set the luminance of the backlight based on two pieces of information, a peak level of the video signal in each of a plurality of partial display areas into which the display screen is divided, and a respective reference position of said each partial display area on the display screen, the backlight having a plurality of partial light-emitting sections each having a respective light source so to enable each partial light-emitting section to emit light independently of each other, each said partial light-emitting section being respectively associated with one of the partial display areas, and the processing section being configured to (i) obtain the respective peak level for said each partial display area, (ii) calculate a corrected peak level for said each partial display area by use of the respective peak level for said each partial display area and respective factor data which is associated with the respective reference position of the respective partial display area, and (iii) set for each of the partial light-emitting sections a luminance level according to the corrected peak level of the partial display area corresponding to the partial light-emitting section, wherein the processing section is configured to determine changes for the respective factor data according to at least one of (i) an operation mode of a plurality of operation modes of the display device or (ii) content to be displayed.

9. A display method comprising:

correcting a video signal and setting luminance of a backlight based on two pieces of information, a peak level of the video signal in each of a plurality of partial display areas into which a display screen is divided, and factor data obtained from a data map made up of a respective reference position of said each partial display area on a display screen and the factor data that are associated with each other so as to display an image based on the corrected video signal, the backlight having a plurality of partial light-emitting sections each having a respective light source so to enable each partial light-emitting section to emit light independently of each other, each said partial light-emitting section being respectively associated with one of the partial display areas, and a corrected peak level for said each partial display area being calculated by use of the respective peak level for said each partial display area and respective factor data which is associated with the respective reference position of the respective partial display area, and for each of the partial light-emitting sections a luminance level is set according to the corrected peak level of the partial display area corresponding to the partial light-emitting section, determining changes for the data map according to at least one of (i) an operation mode of a plurality of operation modes of the display device or (ii) content to be displayed.

* * * * *